US007766596B2

(12) United States Patent
Smith et al.

(10) Patent No.: US 7,766,596 B2
(45) Date of Patent: Aug. 3, 2010

(54) ATTACHMENT FOR A TELESCOPIC MATERIAL HANDLER FOR MANIPULATING A LOAD WITH FIVE DEGREES OF FREEDOM

(75) Inventors: Daniel Allen Smith, McConnellsburg, PA (US); Korry D. Kobel, Atlanta, GA (US); Ignacy Puszkiewicz, Smithsburg, MD (US); Christopher A. Haught, McConnellsburg, PA (US); Todd Bradley Wyant, McConnellsburg, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 138 days.

(21) Appl. No.: 10/590,993

(22) PCT Filed: Mar. 30, 2005

(86) PCT No.: PCT/US2005/010833

§ 371 (c)(1),
(2), (4) Date: Aug. 29, 2006

(87) PCT Pub. No.: WO2005/096743

PCT Pub. Date: Oct. 20, 2005

(65) Prior Publication Data

US 2007/0189882 A1 Aug. 16, 2007

Related U.S. Application Data

(60) Provisional application No. 60/557,418, filed on Mar. 30, 2004.

(51) Int. Cl.
*E04G 21/14* (2006.01)
*B66C 23/00* (2006.01)

(52) U.S. Cl. ..... 414/11; 414/627; 414/620; 414/736; 414/752.1; 414/744.4; 901/16; 901/40; 455/420; 701/50; 294/65

(58) Field of Classification Search ..... 294/65, 294/907, 64.1; 414/10–12, 590, 693, 666, 414/670, 672, 607, 758, 763, 783; 901/15–18, 901/31, 36, 39–40; 455/418–420
See application file for complete search history.

(56) References Cited

U.S. PATENT DOCUMENTS 3,598,263 A * 8/1971 Ehmke ..... 414/620

(Continued)

FOREIGN PATENT DOCUMENTS

CH 677198 4/1991

(Continued)

*Primary Examiner*—Gregory W Adams
(74) *Attorney, Agent, or Firm*—Nixon & Vanderhye P.C.

(57) ABSTRACT

An attachment for a telescopic material handler supplies five degrees of freedom (DOF) for the task of picking, manipulating and aiding in the installation of vertical and horizontal wall cladding and other construction materials. The cladding can be of a size up to 1.3×8.0 m and a mass of 350 kg. The control and positioning of the load is accomplished through standard operation of the telehandler in conjunction with wireless control of the five DOF of the device. Hydraulic power for the device functions may be supplied through the telehandler auxiliary circuit. The auxiliary flow also powers a hydraulic generator, which supplies the device with electrical power for both system logic and control and vacuum generation. The cladding panels are handled by the vacuum system.

7 Claims, 15 Drawing Sheets

U.S. PATENT DOCUMENTS

| | | | | | |
|---|---|---|---|---|---|
| 3,630,389 | A | * | 12/1971 | Schmidt et al. | 414/4 |
| 4,460,208 | A | * | 7/1984 | Hoffman | 294/65 |
| 4,828,304 | A | * | 5/1989 | No et al. | 294/2 |
| 4,878,798 | A | * | 11/1989 | Johansson | 414/280 |
| 5,142,803 | A | * | 9/1992 | Lang | 40/411 |
| 5,413,454 | A | * | 5/1995 | Movsesian | 414/729 |
| 5,609,377 | A | * | 3/1997 | Tanaka | 294/65 |
| 6,082,080 | A | * | 7/2000 | Holter et al. | 53/540 |
| 6,467,824 | B2 | * | 10/2002 | Bolotin et al. | 294/64.1 |
| 2003/0036368 | A1 | * | 2/2003 | Higgs | 455/92 |
| 2004/0052627 | A1 | * | 3/2004 | Rau et al. | 414/699 |

FOREIGN PATENT DOCUMENTS

| | | | |
|---|---|---|---|
| DE | 3834311 | A1 * | 4/1990 |
| EP | 1 043 127 | | 10/2000 |
| EP | 1 336 702 | | 3/2003 |
| FR | 2 669 361 | | 5/1992 |
| GB | 2 351 116 | | 12/2000 |
| GB | 2 358 012 | | 7/2001 |
| GB | 2 390 079 | | 12/2003 |
| GB | 2 390 597 | | 11/2005 |
| GB | 2 415 183 | | 3/2006 |
| JP | 8-114027 | | 5/1996 |
| SU | 1472403 | | 4/1989 |
| WO | WO 95/25210 | | 9/1995 |
| WO | WO 00/37747 | | 6/2000 |

* cited by examiner

Panel Release

Flipped Panel Pickup

ATTACHMENT FOR A TELESCOPIC MATERIAL HANDLER FOR MANIPULATING A LOAD WITH FIVE DEGREES OF FREEDOM

CROSS-REFERENCES TO RELATED APPLICATIONS

This application is the U.S. national phase of International PCT Application No. PCT/US2005/010833, filed Mar. 30, 2005, which designated the United States. PCT/US2005/010833 claims the benefit of U.S. Provisional Patent Application Ser. No. 60/557,418, filed Mar. 30, 2004. The entire contents of these applications are herein incorporated by reference.

STATEMENT REGARDING FEDERALLY SPONSORED RESEARCH OR DEVELOPMENT (NOT APPLICABLE)

BACKGROUND OF THE INVENTION

The present invention relates to an attachment for a telescopic material handler and, more particularly, to such an attachment for manipulating a load with five degrees of freedom.

Modern construction technologies utilize several types of materials delivered in the form of long panels. The panels have great advantages from aesthetic (less visible joints, high quality of finish), safety (high fire resistance) and economical (minimal number of construction steps, good insulation, air tight) points of view. Installation, however, requires special equipment and processes to install them in a safe, efficient way with minimal losses due to damage.

There are known at least two products for telescoping material handlers and vertical mast forklifts. In one version, the attachments are designed for work with different carriers—supported by forks of a forklifts and designed to connect to a boom of a telescoping material handler. Usually, telescoping handler attachments have an operator platform. The attachments are fully self-contained. A vacuum pump, a hydraulic system for lift functions and a control system are powered by batteries built into the attachment base. The attachments slip over forks of the telehandler making them easy to apply on different types of machines. Another attachment is designed to hang from a crane.

Another version uses a quick attachment change connection usually used with rotating models of telehandlers. Rotating machines have the boom mounted on its rotating upper structure (turntable), very similar to mobile cranes and excavators. Additional mechanisms effect fine adjustment and positioning of the panel.

BRIEF SUMMARY OF THE INVENTION

The present device is a telescopic telehandler (e.g., forklift) attachment that is to be used to pick, manipulate, transport and aid in the installation of both vertical and horizontal building panels (cladding) and other construction materials such as pipes and the like. These tasks will be achieved through wireless control over five degrees of freedom and the interaction of an additional operator in an aerial work platform (AWP).

The device is able to handle variety of cladding panels and other construction materials. Exemplary panels have dimensions up to 1.3×8.0 meters in size and a mass of 350 kg or more. Panels are preferably handled by means of an onboard vacuum system and are manipulated and controlled over five degrees of freedom by the construction of the attachment.

In an exemplary embodiment of the invention, an attachment for a telescopic material handler enables support and manipulation of a load. The attachment includes a gripping system that securely holds the load, and a manipulation assembly supporting the gripping system. The manipulation assembly is movable in at least five degrees of freedom. An operator-controlled wireless control system effects control of the manipulation assembly. Preferably, the load is either building panels or pipes.

In one arrangement, the manipulation assembly is preferably pivotable about a first axis generally perpendicular to a ground plane, defining a first degree of freedom; the manipulation assembly includes a main arm supporting the gripping system, wherein the main arm is pivotable about a second axis generally parallel to the ground plane, defining a second degree of freedom; the manipulation assembly also includes a panel rotator assembly attached to the main arm via a four bar mechanism, wherein the four bar mechanism pivots the panel rotator assembly about a third axis generally parallel to the ground plane and the second axis, defining a third degree of freedom and effecting rotation of the load; wherein the panel rotator assembly rotates the gripping system relative to the main arm about a fourth axis generally parallel to the ground plane and perpendicular to the second and third axes, defining a fourth degree of freedom and effecting rotation of the load about a normal axis; and wherein the gripping system is translatable relative to the main arm, defining a fifth degree of freedom.

The gripping system may include a vacuum pump, a plurality of vacuum cups, and a vacuum reservoir. In this context, the vacuum cups may be divided into at least two independent circuits, where each independent circuit includes a vacuum reservoir. Each independent circuit of the gripping system may further include a manifold valve that separates its respective vacuum reservoir from the vacuum pump, wherein upon failure of the vacuum pump, each of the manifold valves closes to preserve vacuum in its respective reservoir. The gripping system may further include a vacuum switch that measures a vacuum level, where the attachment further includes a first signal coupled with the vacuum switch, the first signal indicating that sufficient vacuum has been achieved. The attachment may also include a system controller receiving input from the vacuum switch and opening and closing the manifold valves based on the vacuum level. Preferably, the system controller controls the vacuum pump and the first signal, where the attachment further includes at least a second signal activated by the system controller when the vacuum level is below a predetermined level. In one arrangement, the gripping system additionally includes a clamp. Still further, the vacuum cups may be provided with a soft touch attachment including isolation and suspension components that protect the load.

The operator-controlled control system may include a primary radio transmitter and a secondary radio transmitter, where control of the load i& transferable between the primary and secondary radio transmitters. The attachment preferably also includes a visual indication of which radio transmitter is in control of the load.

In another exemplary embodiment of the invention, a method of manipulating a load includes the steps of holding the load with a gripping system; and supporting the gripping system with a manipulation assembly for movement in at least five degrees of freedom via an operator-controlled control system. If the load is a cladding panel, the method may further include flipping the cladding panel over prior to installation. The flipping step may include the steps of attaching the gripping system to a first side of the cladding panel, rotating the cladding panel about an axis generally parallel to a longitudinal axis of the cladding panel, releasing the cladding panel onto a support member, and attaching the gripping system to a second side of the cladding panel.

In yet another exemplary embodiment of the invention, an attachment for a telescopic material handler enabling support and manipulation of a load includes a gripping system that securely holds the load, the gripping system including a vacuum pump, a plurality of vacuum cups, and a vacuum reservoir, wherein the vacuum cups are divided into at least two independent circuits, and wherein each independent circuit includes a vacuum reservoir; a manipulation assembly supporting the gripping system, the manipulation assembly being movable in at least five degrees of freedom; an operator-controlled control system effecting control of the manipulation assembly; and a plurality of indicators signaling a status of the attachment.

BRIEF DESCRIPTION OF THE DRAWINGS

These and other aspects and advantages of the present invention will be described in detail with reference to the accompanying drawings, in which.

DETAILED DESCRIPTION OF THE INVENTION

Manipulation of the load is accomplished with five powered degrees of freedom (DOF), and the hydraulic power for these motions may be obtained from the telehandler auxiliary circuit. The structure and its motions are described below from the telehandler attachment out to the vacuum cups. All of the device's degrees of freedom are controlled via a wireless system (described below). The controls can be sees in FIG. 1.

Figure 2:
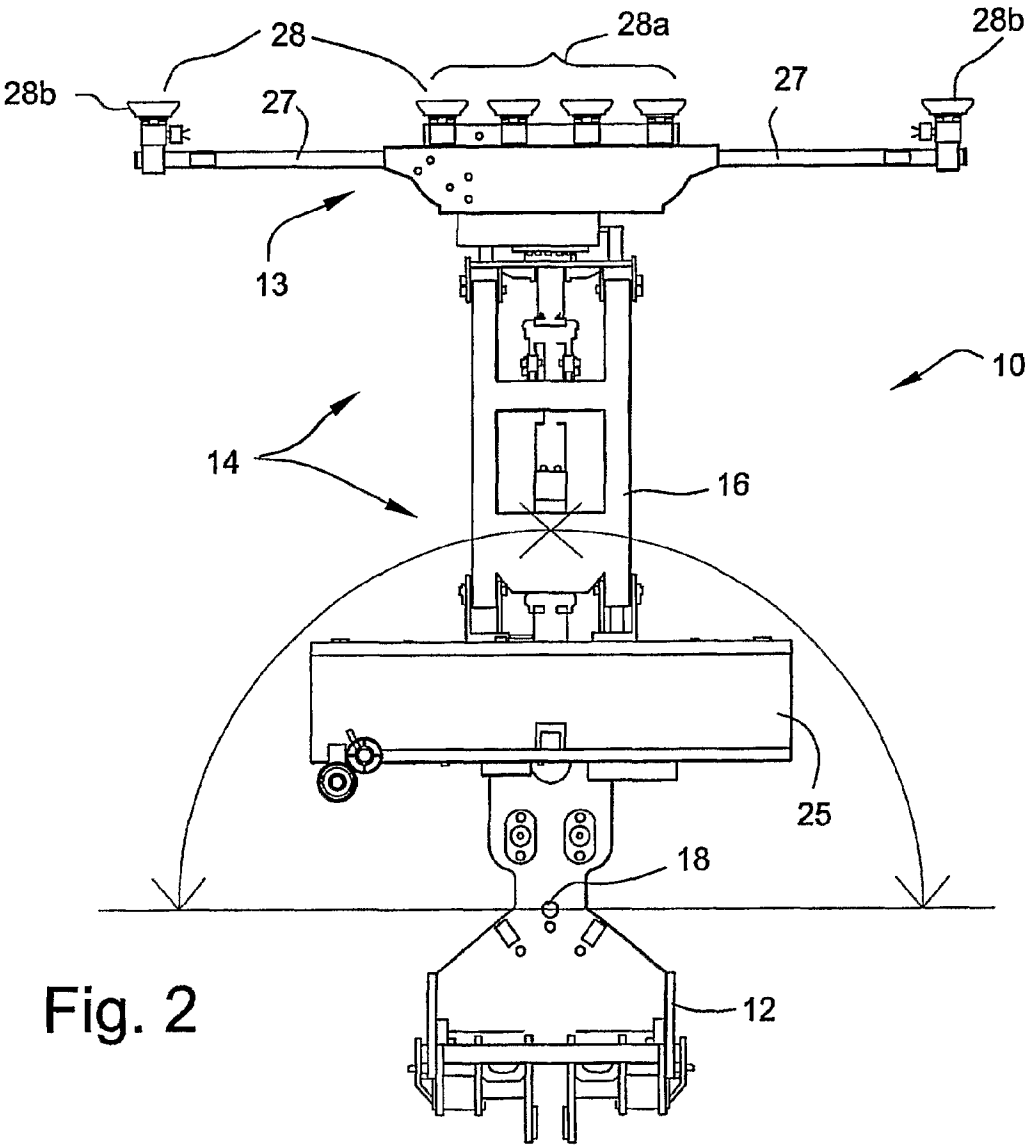
FIG. 2 is a plan view of the attachment showing panel swing.
Figure 3:
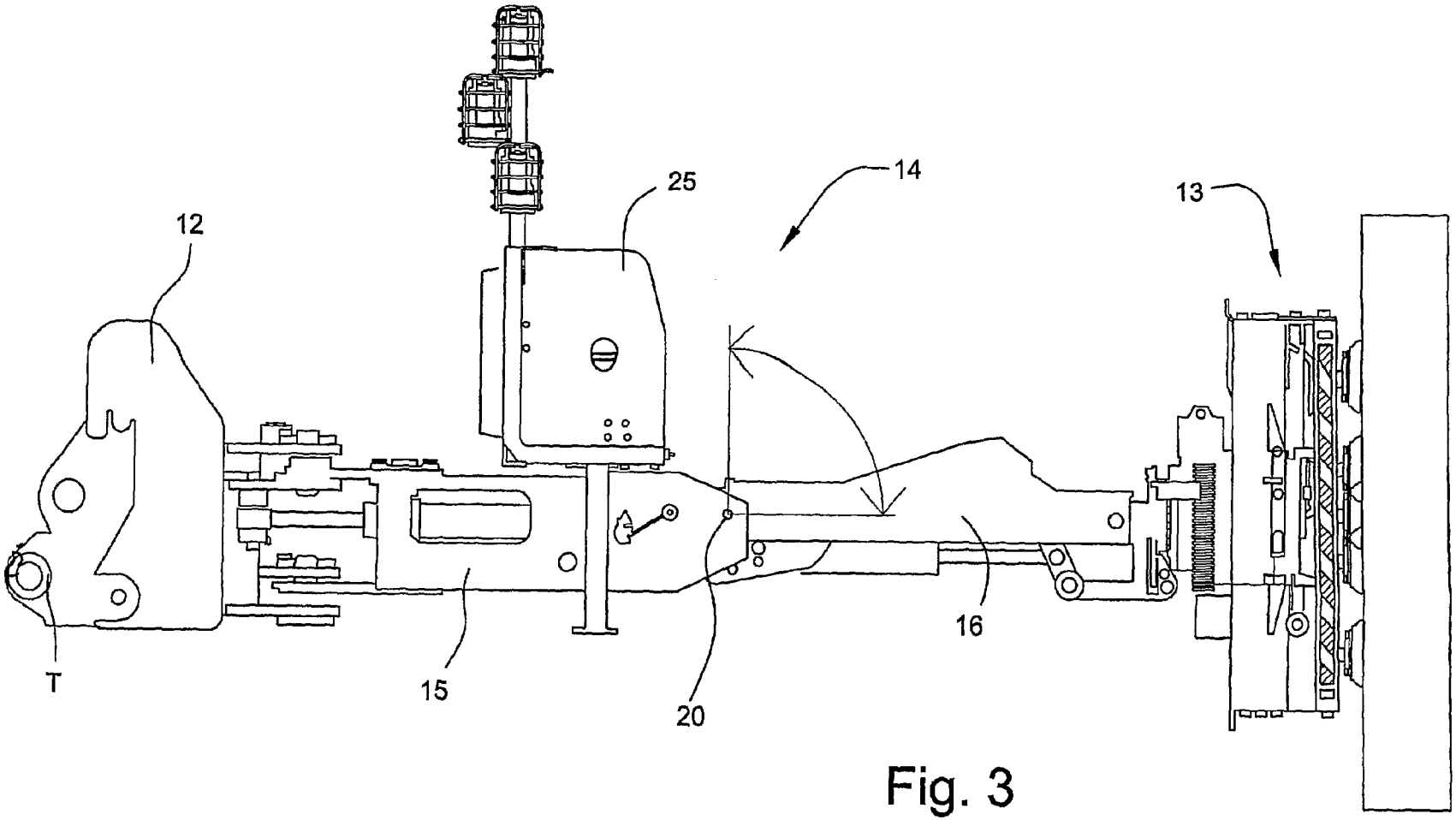
FIG. 3 is a side view of the attachment showing panel lift.

FIG. 2 is a plan view of the telehandler attachment 10 of the present invention. The attachment 10 includes a coupling section 12 coupleable with the telehandler via any suitable means. FIG. 3 is a side view of the attachment 10 showing the coupling section 12 fixed to a portion of the telehandler T.

The attachment 10 includes a gripping system 13 for securely holding the load and a manipulation assembly 14 supporting the gripping system 13. As described in more detail below, the manipulation assembly 14 is movable in at least five degrees of freedom.

In this context, the manipulation assembly 14 is secured to the coupling section 12 via a first pivot 18 having an axis generally perpendicular to a ground plane (i.e., the plane of the page in FIG. 2), defining a first DOF. The first DOF allows for plus/minus rotation (for example +/−90°) of the entire manipulation assembly 14 with respect to the telehandler boom. This rotation can be seen via arrows in FIG. 2 and is used to position the manipulation assembly 14 normal (in the horizontal/ground plane) to the cladding surface.

With reference to FIG. 3, the manipulation assembly 14 includes a base arm 15 secured to the coupling section 12 and a main arm 16 pivotally attached to the base arm 15 via a second pivot 20. The main arm 16 supports the gripping system 13 as shown. Pivoting of the main arm 16 about the second pivot 20 defines a second DOF. The pivot 20 is oriented with its axis generally parallel to the ground plane. The second DOF rotates the main arm 16 of the device from horizontal to vertical, as shown via arrows in FIG. 3. In a preferred embodiment, this motion in effect allows for 900 mm of horizontal and vertical (albeit interdependent due to the traversed are) adjustment of the panel.

Figure 4:
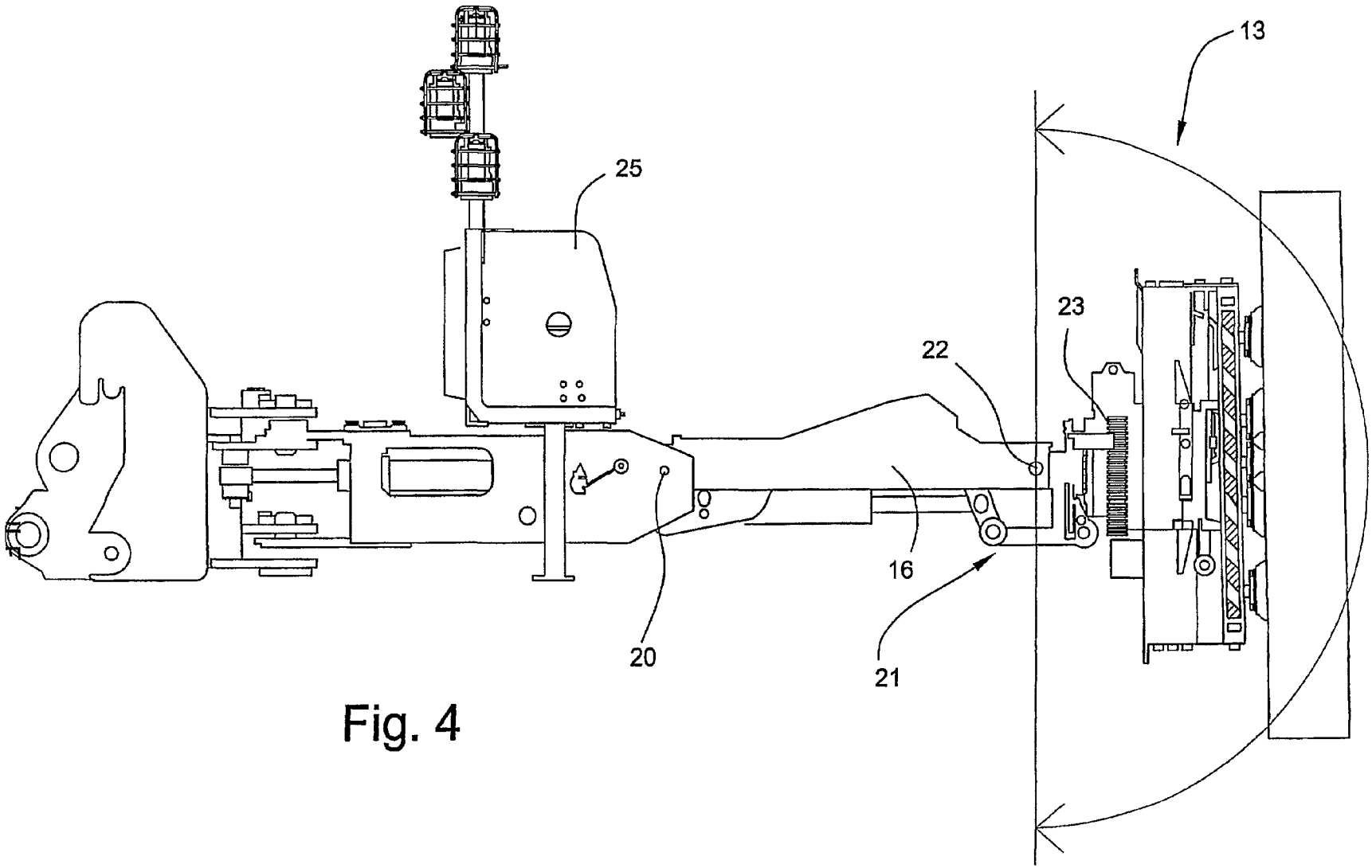
FIG. 4 is a side view of the attachment showing panel tilt.

With reference to FIG. 4, the manipulation assembly 14 additionally includes a four-bar mechanism 21 that moves a panel rotator assembly 23 installed between the main arm 16 and the gripping system 13. The panel rotator assembly 23 is attached through the four bar mechanism 21 to the main arm 16 via a third pivot 22 oriented with its axis generally parallel to the ground plane and the axis of the second pivot 20. Pivoting about the third pivot 22 defines a third DOF. The third DOF is achieved by powering the panel rotator assembly 23 through the four-bar mechanism 21 and allows for rotation of the panel, for example 180° rotation, as seen via arrows in FIG. 4, in order to un-nest the packaged panels and/or flip the panels delivered packaged in the wrong orientation.

Figure 5:
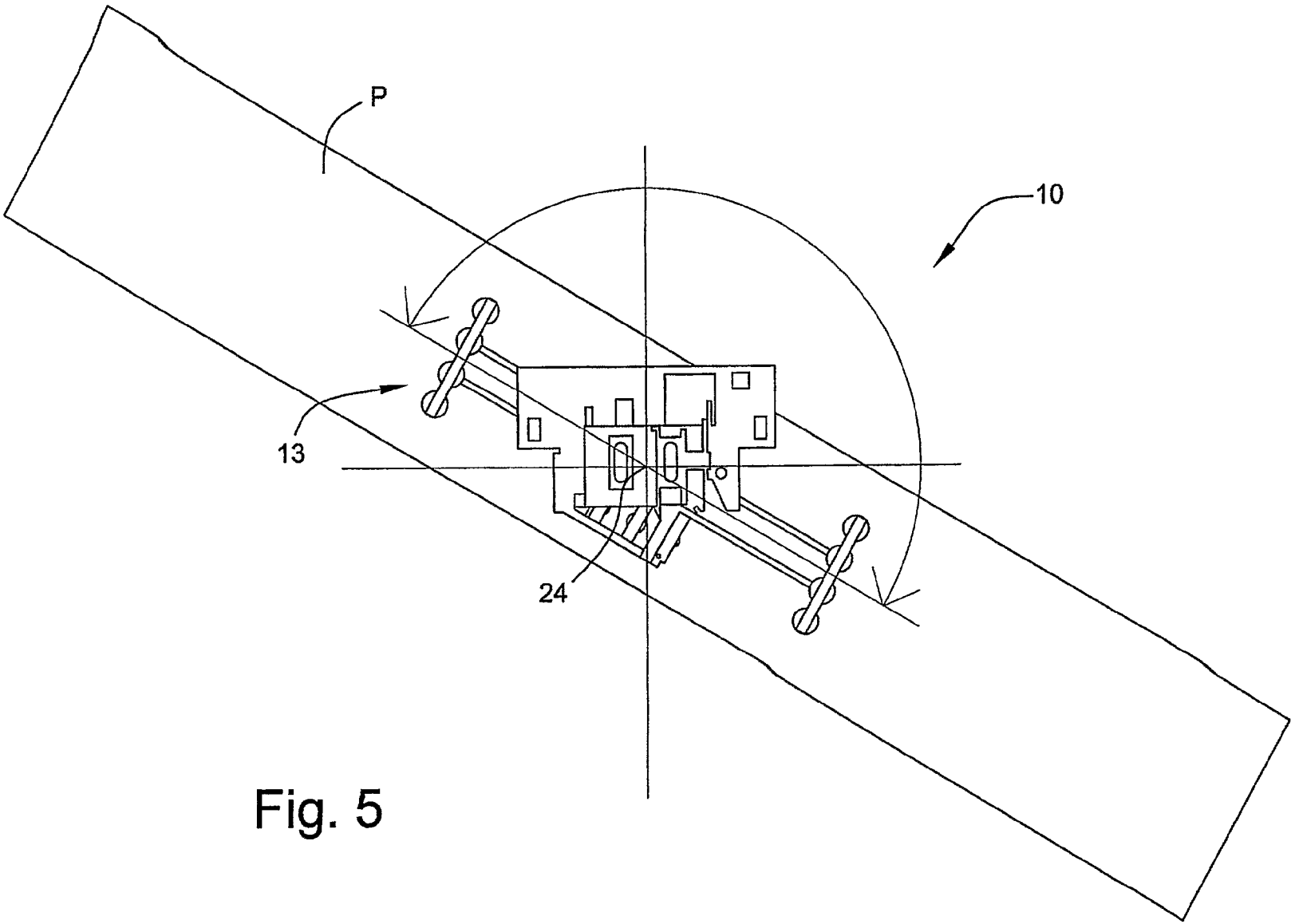
FIG. 5 is an end view of the attachment showing rotation of a panel.

FIG. 5 is an end view of the attachment showing the gripping system 13 rotatable relative to the main arm 16 by means of the panel rotator assembly 23 about a fourth pivot 24 whose axis is oriented generally parallel to the ground plane and perpendicular to the axes of the second and third pivots 20, 22, defining a fourth DOF. As shown by the arrows in FIG. 5, the fourth DOF effects rotation (for example plus/minus 100 degrees) about the panel normal axis from a transport position of horizontal to provide for either horizontal or vertical cladding operations. FIG. 5 shows the gripping system 13 supporting a cladding panel P as a load. The load is exemplary as other construction materials such as pipes or the like may also be supported by the gripping system 13.

Figure 6:
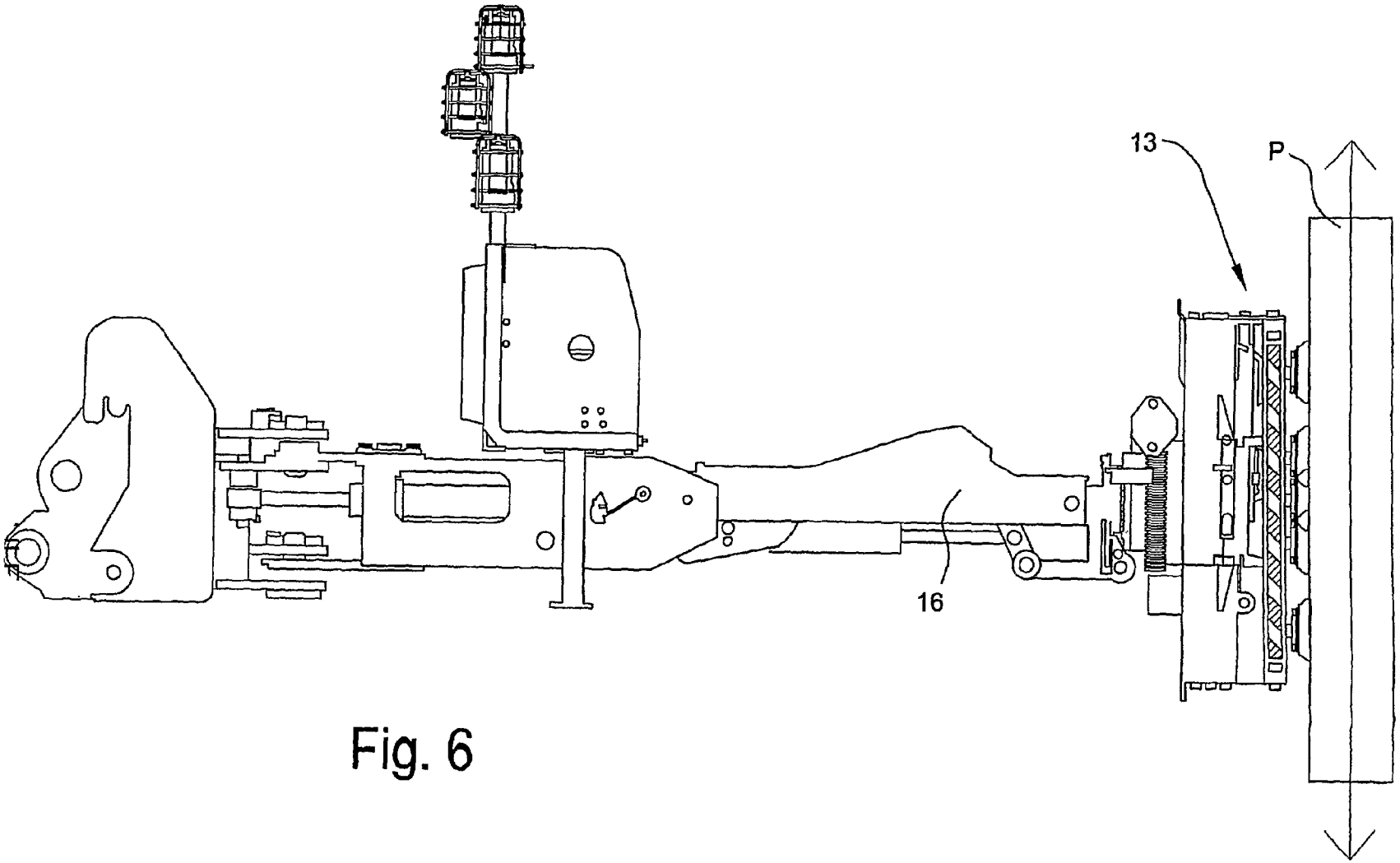
FIG. 6 is a side view of the attachment showing panel shift.

With reference to FIG. 6, the gripping system 13 is also translatable relative to the main arm 16 as shown via the arrows in FIG. 6. This translation defines a fifth DOF, which provides panel translation (for example plus/minus 150 mm) in a direction normal to the panel edge. This motion seats the 'tongue and groove' seal that is incorporated on the cladding panels P.

The structure of the device also includes a compartment 25 with a lockable, hinged hood that houses the majority of the electronic, pneumatic and hydraulic components. The device also provides for some flexibility in its transport package size. The wings 27 (FIG. 2) that support the outer two vacuum reservoirs can be folded back to reduce the package width.

Figure 7:
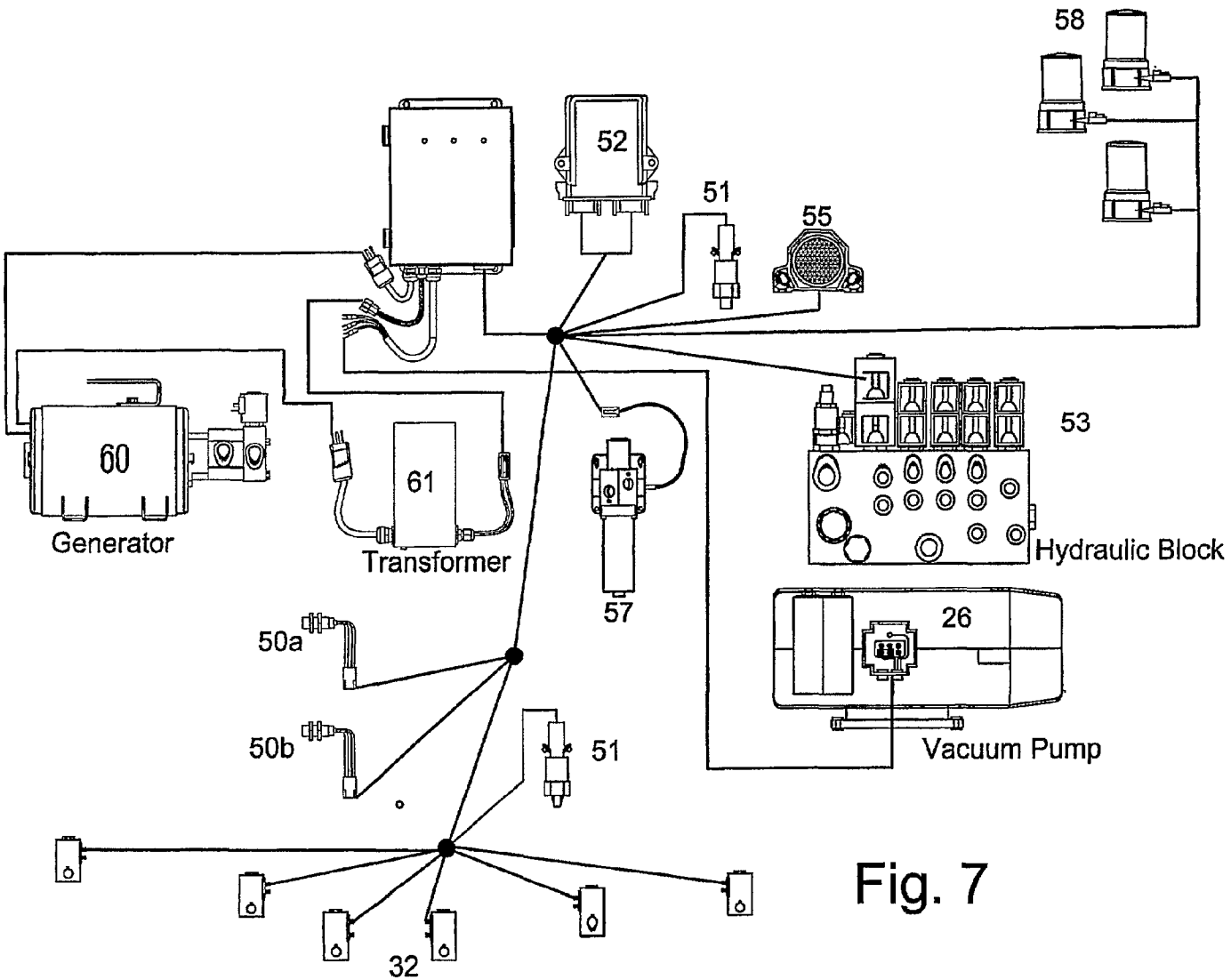
FIG. 7 is a schematic illustration of the electrical and control system.
Figure 8:
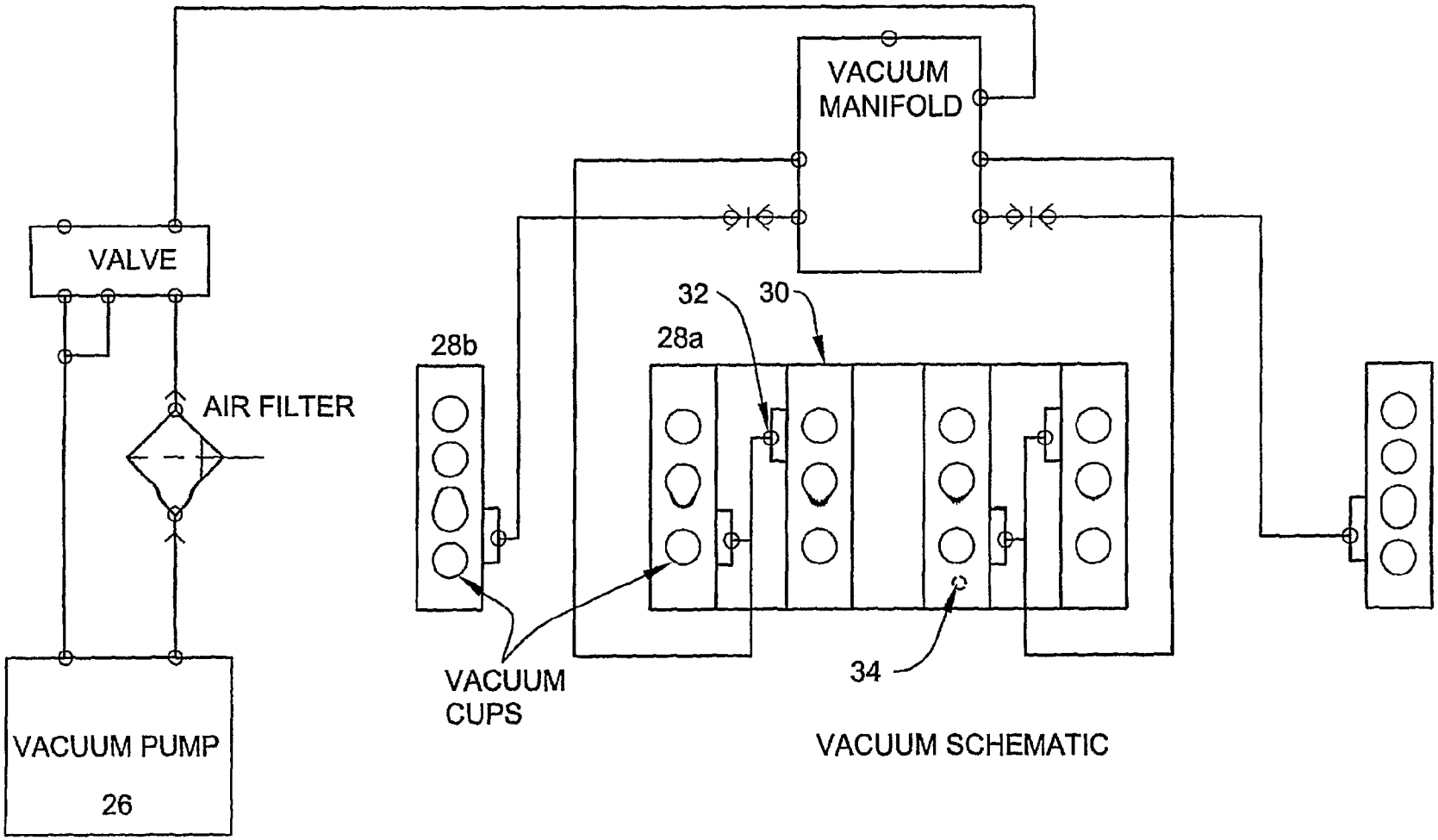
FIG. 8 is a schematic illustration of the vacuum system.

With reference to FIGS. 2, 7 and 8, the gripping system 13 includes a vacuum pump 26, vacuum cups 28 divided into independent circuits, each circuit with its own vacuum reservoir 30, and manifold valves 32. In an exemplary embodiment, twenty vacuum cups 28 are divided into six independent circuits, four circuits with three vacuum cups 28 and two circuits with four vacuum cups 28. As shown in FIG. 2, there are three groups of vacuum cups; four circuits with three vacuum cups in a central cluster 28*a* and two circuits 28*b* with four vacuum cups to the right and left of the central cluster

28*a*. Each group of vacuum cups is connected to a vacuum reservoir 30, storing vacuum in the event of a vacuum system failure. A normally closed manifold valve 32 separates each vacuum reservoir 30 from the rest of the vacuum system. The vacuum pump 26, mounted in the compartment, creates the vacuum in the system.

The vacuum level in the system is measured using a vacuum switch 34. A signal such as a green light will illuminate on the device when sufficient vacuum is achieved. Upon sufficient vacuum, the cladding panel P can be manipulated into the appropriate mounting position and fastened to the building. Once the cladding panel P is attached to the building, the vacuum pressure is released from all circuits. The vacuum release is initiated by an operator through a switch selection on the wireless control system.

In the event of a failure in the vacuum system (as indicated by the vacuum switch 34), an alarm will sound, and the sufficient vacuum indicator will go off. The manifold valves 32 on each of the vacuum reservoirs 30 will close, preserving vacuum in each reservoir 30. This remaining vacuum will hold the panel P for a period of time, so the operator can lower the panel into a safe position. A failure in the electrical system or vacuum pump will also cause these valves 32 to close, holding the panel. Upon restart of the vacuum system, the vacuum switch 34 will check for vacuum and assume there is a panel if sufficient vacuum is established by means of the vacuum switch 34, in which case the manifold valves 32 will reopen, and the sufficient vacuum indicator will go on.

Figure 1:
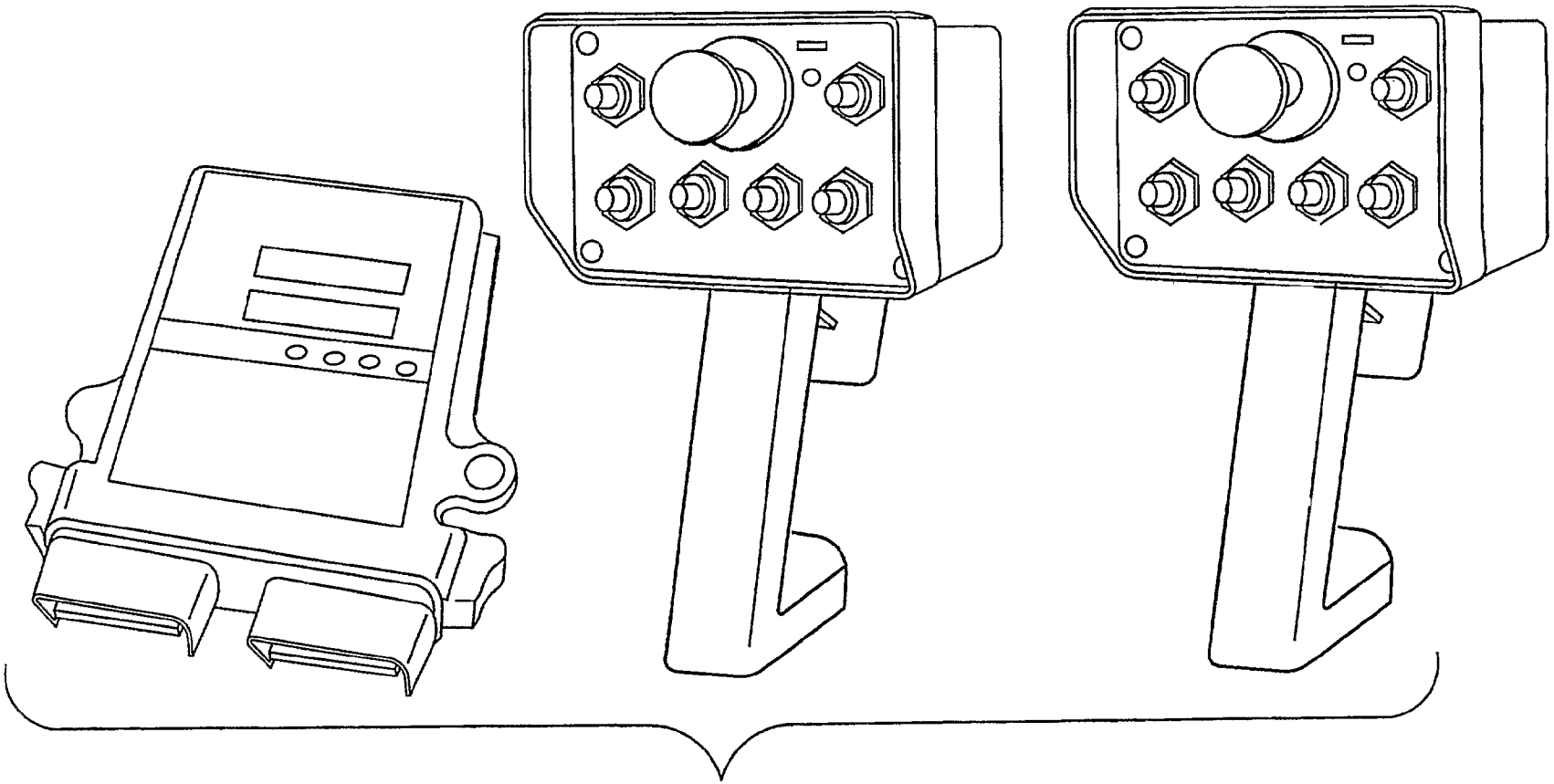
FIG. 1 illustrates the wireless controllers to effect manipulation of the load.

The electrical and control system allows wireless radio remote control of the device, handles failures, stops the operator from moving into an unsafe orientation of the device, and increases the safety of the product. The user will control the device with two preferably differently-colored battery powered radio transmitters (e.g., blue and yellow). The blue transmitter, for example, will be the primary, and the yellow transmitter will be the secondary. One or zero transmitters have control of the device at any time. A pitch/catch system is used to transfer control between transmitters. As shown in FIG. 1, each transmitter includes seven toggle switches, a proportional trigger, and an emergency stop (e-stop). The toggle switches control the vacuum pump, transferring control, releasing the panel, and toggling between the five degrees of freedom. The proportional trigger activates the selected function. The e-stop turns the transmitter off. When the e-stop is pressed, the device shuts down the movement functions, although the vacuum pump status does not change.

The electrical and control system preferably includes two proximity sensors 50*a*, 50*b*—one for each panel lift and tilt, two vacuum switches 51, and one radio receiver 52 with a logic controller (PLC). The system controls the hydraulic block 53, the vacuum pump 26, the audible alarm 55, the manifold valves 32, the panel release valve 57, and three indicators 58. The indicators are preferably differently-colored lights, such as blue, yellow and green. The radio receiver controls the hydraulic block 53, with the exception of the two proximity sensor cutouts, which are controlled via relay logic. The radio receiver also controls the vacuum pump power relay, the panel release valve, and the blue and yellow control lights. The receiver along with relay logic, controls the audible alarm 55, which is enabled when the vacuum pressure holding a panel is unexpectedly lost. Whenever the audible alarm 55 is enabled, the manifold valves 32 are disabled by relay control, causing them to close. The tilt up motion is limited by relay logic to prevent the panel from being tilted beyond 15 degrees from the vertical reference frame of the main lift arm 16 when the lift arm 16 is raised above horizontal. The lift up motion is disabled by relay logic when the panel is tilted back over 15 degrees from the vertical reference frame of the lift arm 16. These cut outs are triggered by the proximity sensors 50*a*, 50*b*. The pump side vacuum switch 51 controls the green light, which is enabled when the system has reached the appropriate vacuum level.

The electrical power to the system is generated by either a hydraulic or engine-powered generator 60. Preferably, power is generated by the generator 60 at 120 VAC and is converted to 12 VDC with a step down transformer 61 and a rectifier. On the 12 VDC circuit, in the preferred arrangement, there are three lights 58, six manifold valves 32, the audible alarm 55, four relays, ten hydraulic valves 53 including a proportional valve, two proximity switches 50*a*, 50*b*, two vacuum switches 51, and the radio controller 52. On the 120 VAC circuit, there are the vacuum pump 26 and the transformer 61.

The electrical and control system increases the safety of the device with proximity sensor 50*a*, 50*b* cutouts, as described above, with the audible alarm 55 and closing the manifold valves 32 on a loss of vacuum, and with the indicator lights 58 to signal the status of the device. When the vacuum holding a panel is unexpectedly lost, the manifold valves 32 close and use a small reservoir of vacuum to hold the panel in place for some time. This allows the panel to be safely lowered to the ground before the vacuum falls unsafely. The blue light flashes when the blue transmitter is in control of the device, and the yellow light flashes when the yellow light is in control. Both lights will flash when neither is in control. The green light flashes when there is enough vacuum to safely maneuver the panel. The lights quickly show the operators who is in control of the system and if the panel is safe to move.

Figure 9:
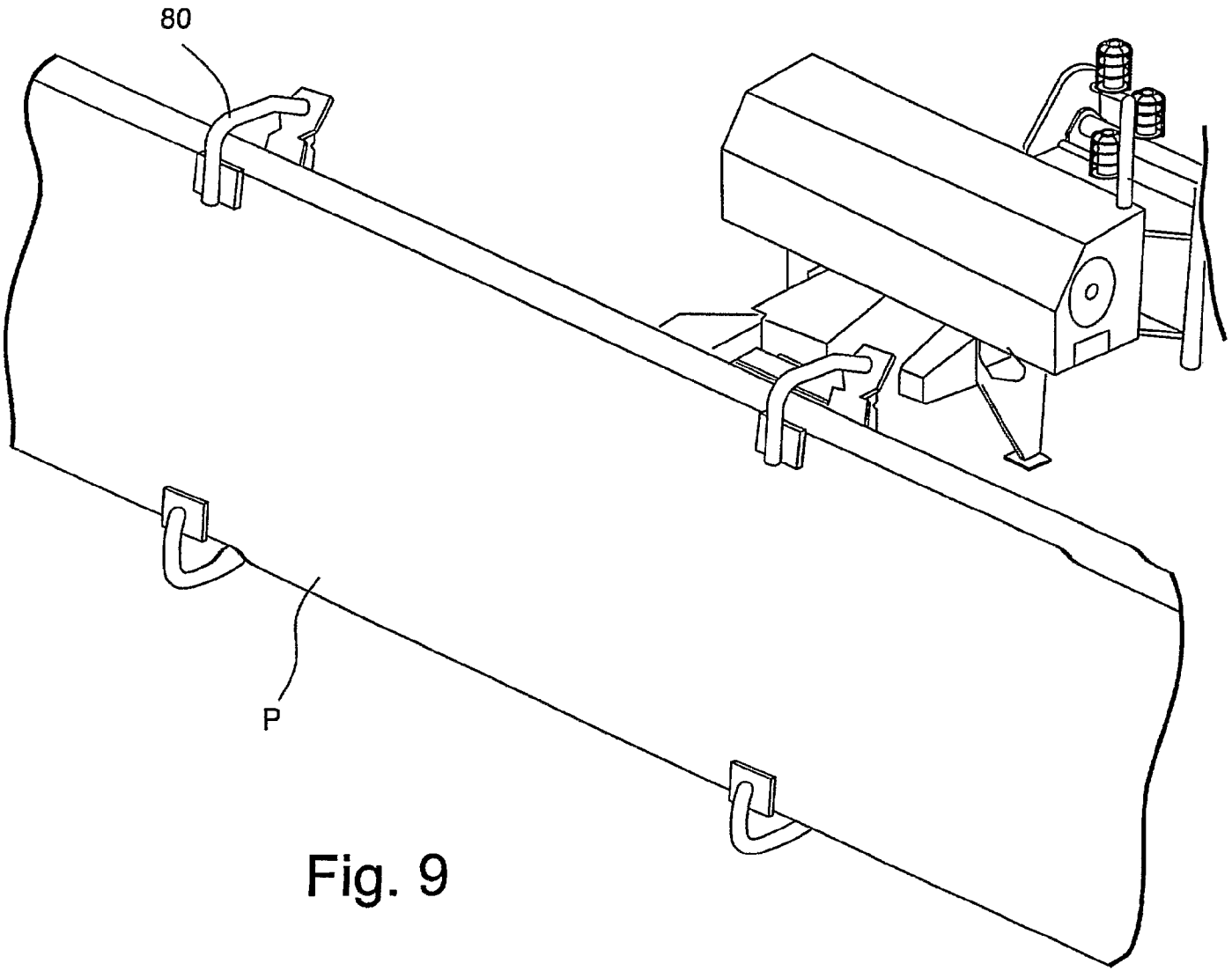
FIGS. 9 and 10 illustrate an alternative arrangement of the gripping system including a clamp.
Figure 10:
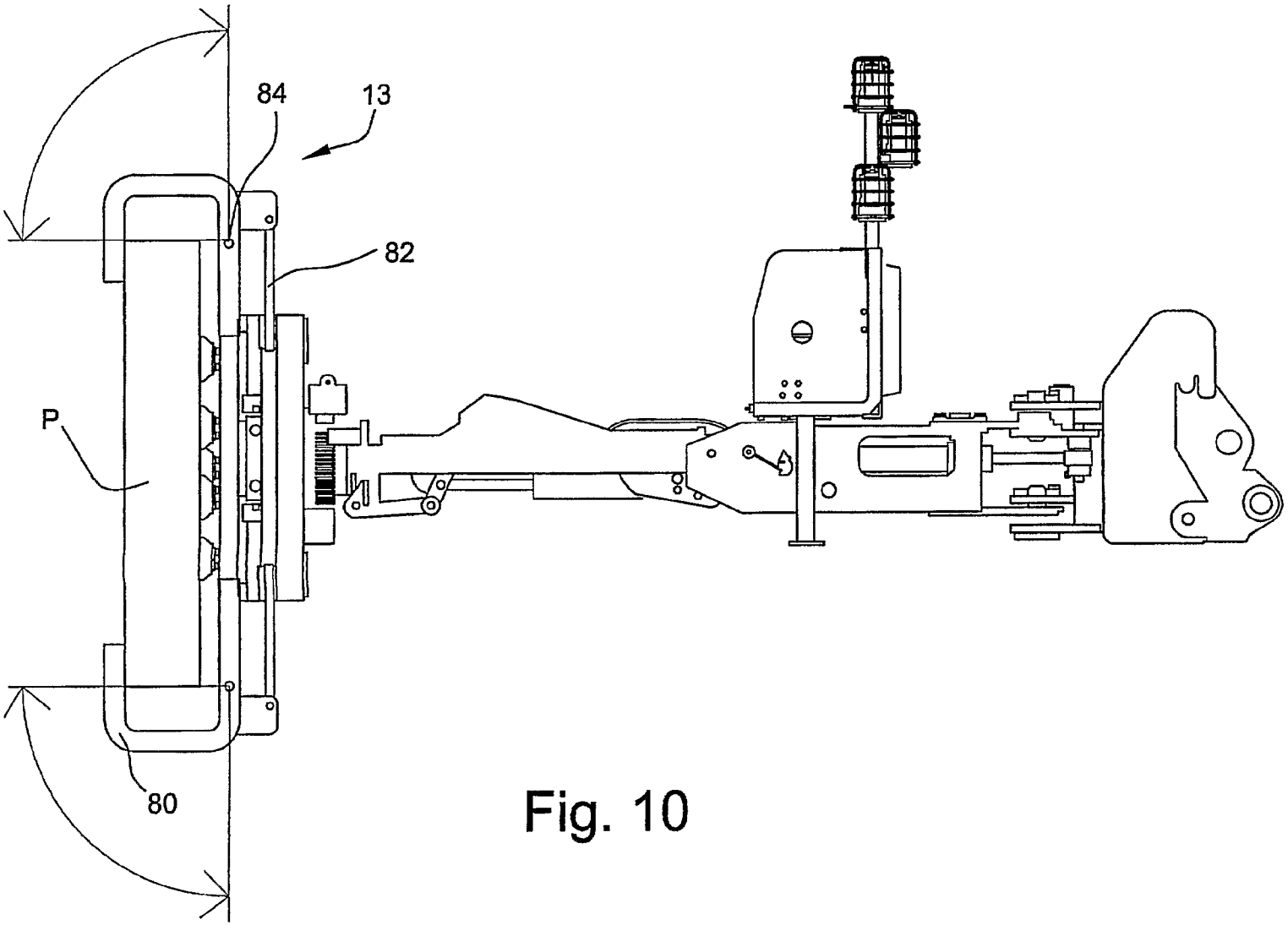
Figure 11:
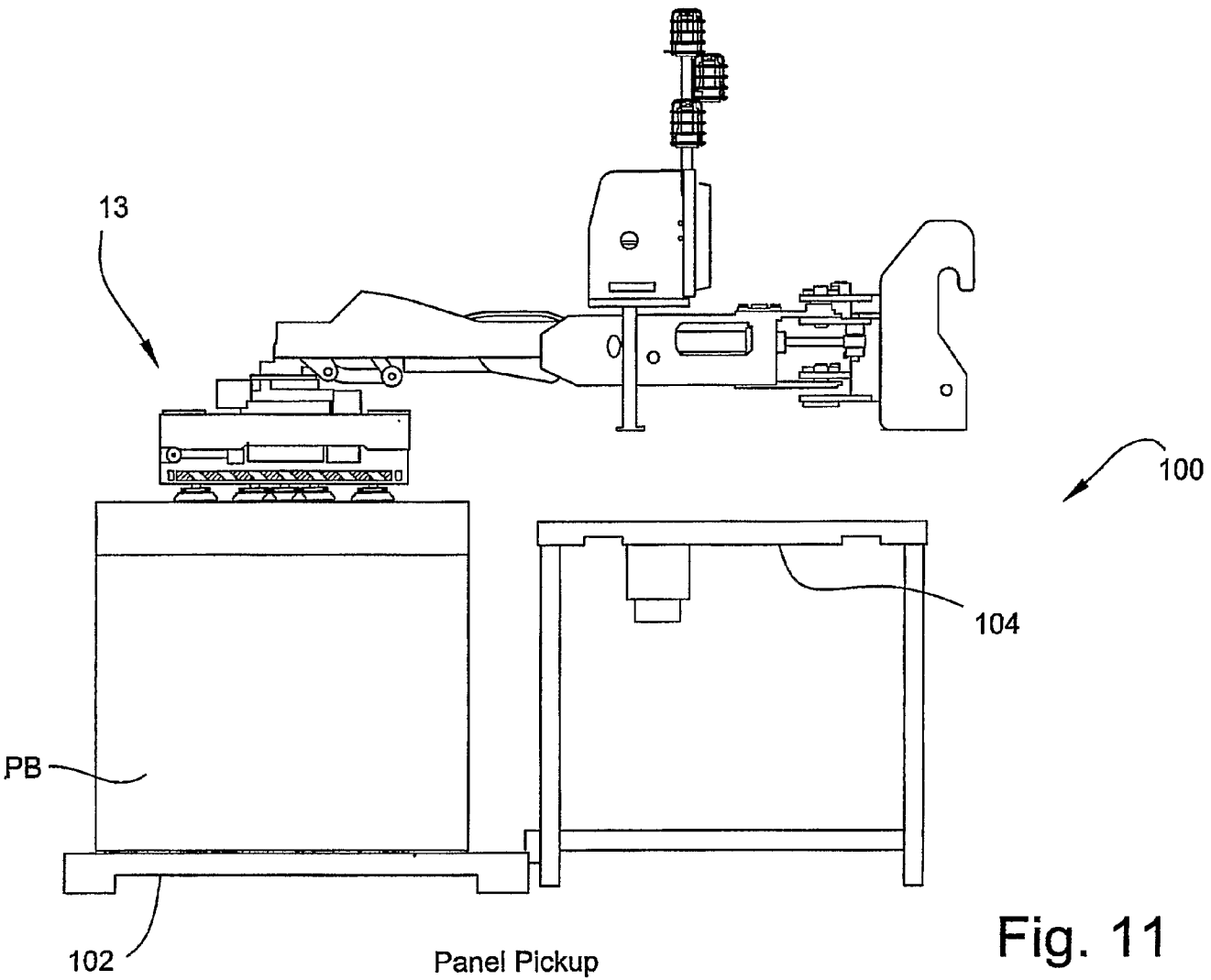
FIGS. 11-14 illustrate a process for flipping a panel.

FIGS. 9 and 10 illustrate an alternative arrangement of the gripping system 13 with additional gripping structure. In this arrangement, two pairs of clamps 80 are provided on the center array of vacuum cups. The clamps 80 are preferably hydraulically actuated via a cylinder 82 and pivot 84 and secure the panel P during transport.

An exemplary application of the invention including installation of cladding panels P will be described with reference to FIGS. 11-14. The invention advantageously provides construction crews with a method of installing cladding panels and other construction materials using two machines: (1) a telehandler with two attachments including (i) a fork and (ii) the telehandler attachment 10 of the invention, and (2) an aerial work platform (AWP).

In installing cladding panels on a building, a material handler with forks initially unloads the delivery truck and stacks panel bundles in a staging area. The material handler with forks moves the panel bundles from the staging area to an area in close proximity to the building. The fork attachment is then changed to the telehandler attachment 10 of the invention.

Figure 12:
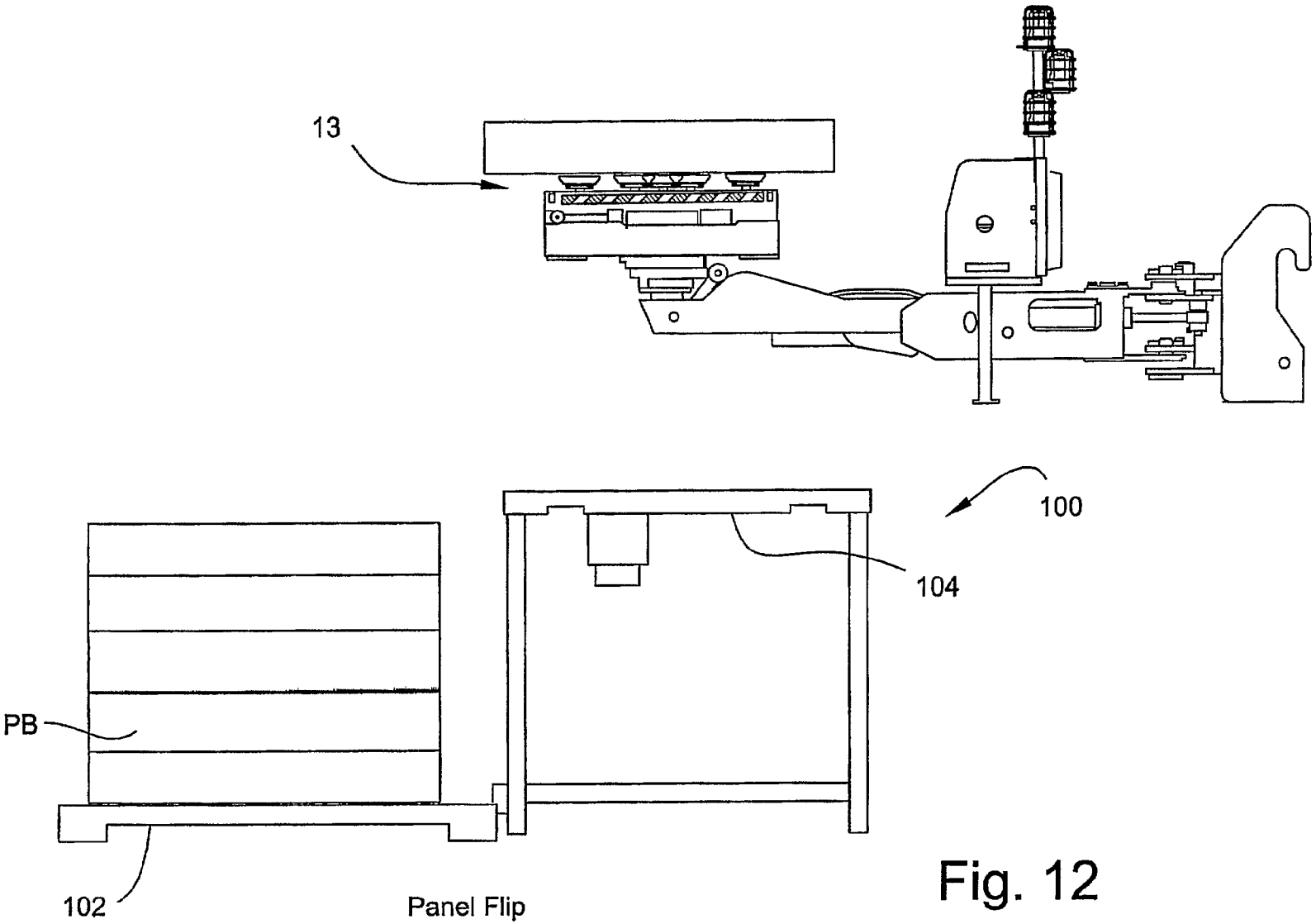
Figure 13:
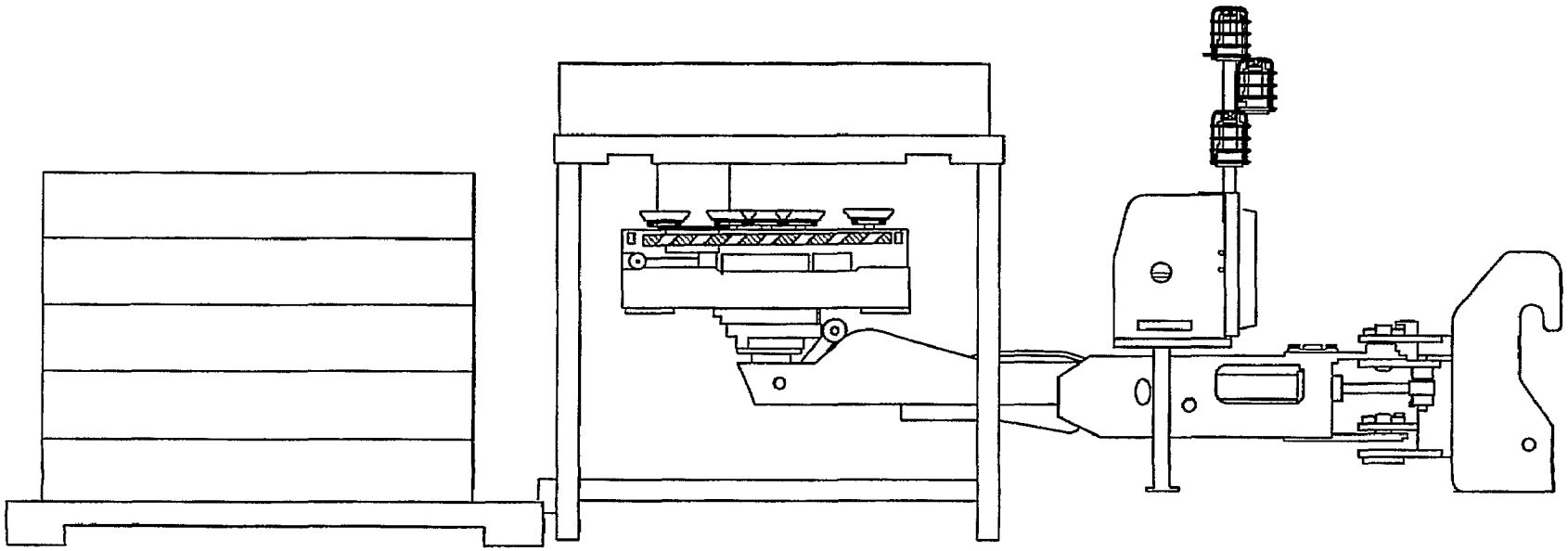
Figure 14:
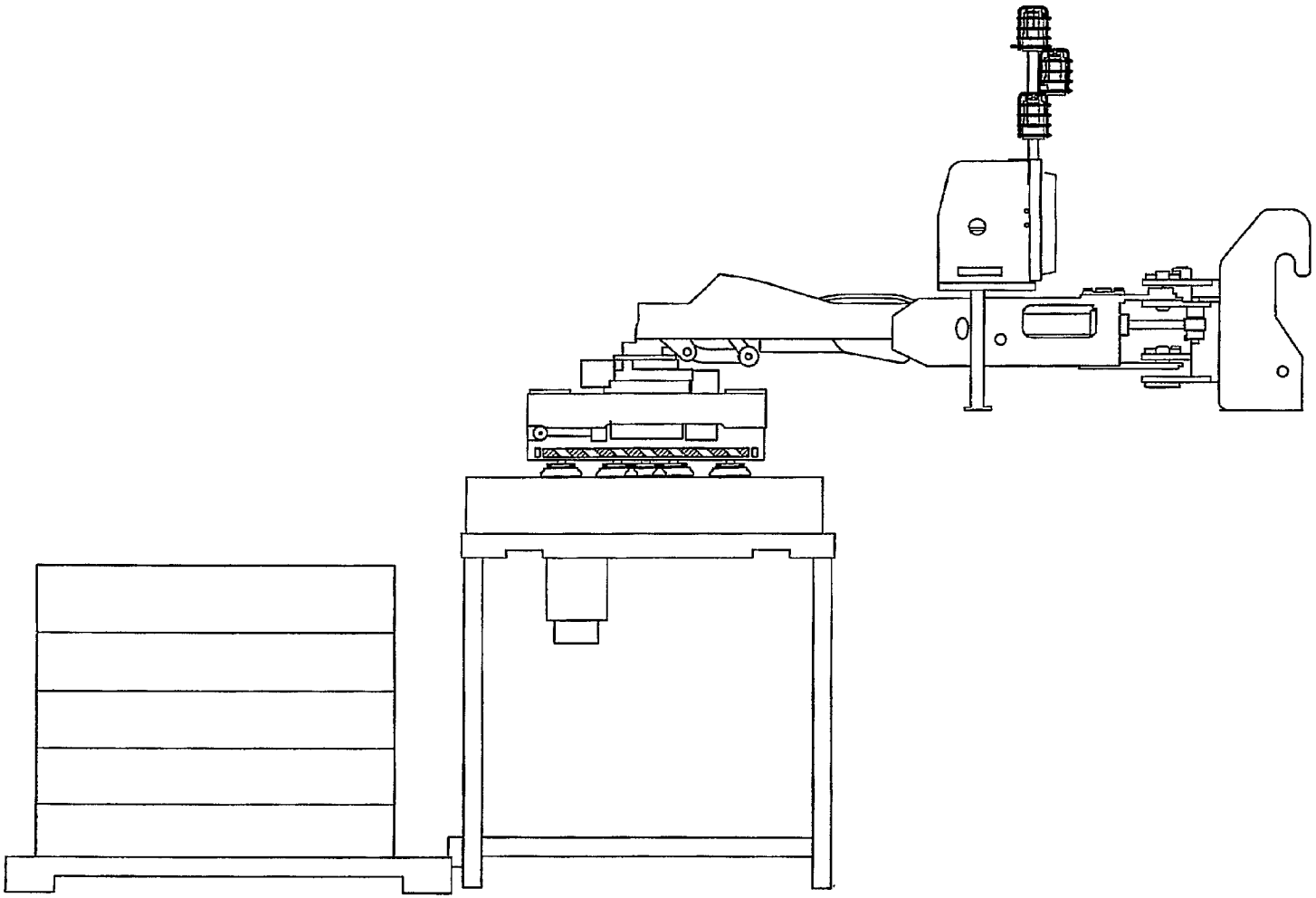

Since all panels for installation have to be picked up on the finished outside surface for installation, no matter how they are delivered, the machine performs panel sorting and flipping as necessary. With reference to FIGS. 11-14, the panel bundle PB rests on a storage shelf 102 of a saw horse accessory 100. The storage shelf 102 serves to prevent the panels from possible damage if they would rest on uneven ground. The accessory also includes a higher surface 104 on which the panel rests during a flipping process. The panel needing to be flipped is picked up by the gripping system 13 of the attachment 10 (FIG. 11), then flipped over by pivoting the four bar mechanism 21 (FIG. 12). The flipped panel is then lowered into engagement with the higher surface 104 of the saw horse accessory 100 and released (FIG. 13). The attachment 10 is then positioned with the gripping system 13 adjacent the opposite side of the panel, and the panel is captured for installation (FIG. 14). The panels are flipped one by one as needed and immediately delivered to the building and installed either in a vertical or a horizontal orientation.

The ability of the device to mechanize sorting and flipping of the panels is of importance for avoiding panel damage and eliminates hand labor after the panel is delivered to the building and positioned in close proximity to its final position.

Cooperation between the operator of telehandler and a worker on the AWP for installing the panel on a building will be described. The worker on the AWP has a better ability to check for proper alignment between the panel being installed and previously-installed panels and to supervise making a joint. The primary and secondary radio control units and signaling method allows the worker on the AWP to take control of some positioning functions of the telehandler attachment 10 to precisely position the panel, prevent damage, and facilitate installation.

After the panel is located in place, and at least some fasteners are placed to keep the newly installed panel temporarily fastened to the building, the attachment 10 releases the panel, and the telehandler is moved to start a new cycle. In the meantime, the worker on the AWP completes installation including installing all fasteners, removing protective film from surface of the panel, and preparing the joint for the next panel.

Another exemplary application utilizes the attachment 10 of the invention along with a cladding installation system coupled with a scissors lift or the like, such as the system described in U.S. patent application Ser. No. 10/834,103, the contents of which are hereby incorporated by reference. In this application, the attachment 10 is utilized to sort and flip the panels as necessary, then deliver the panels to the installation system.

Figure 15:
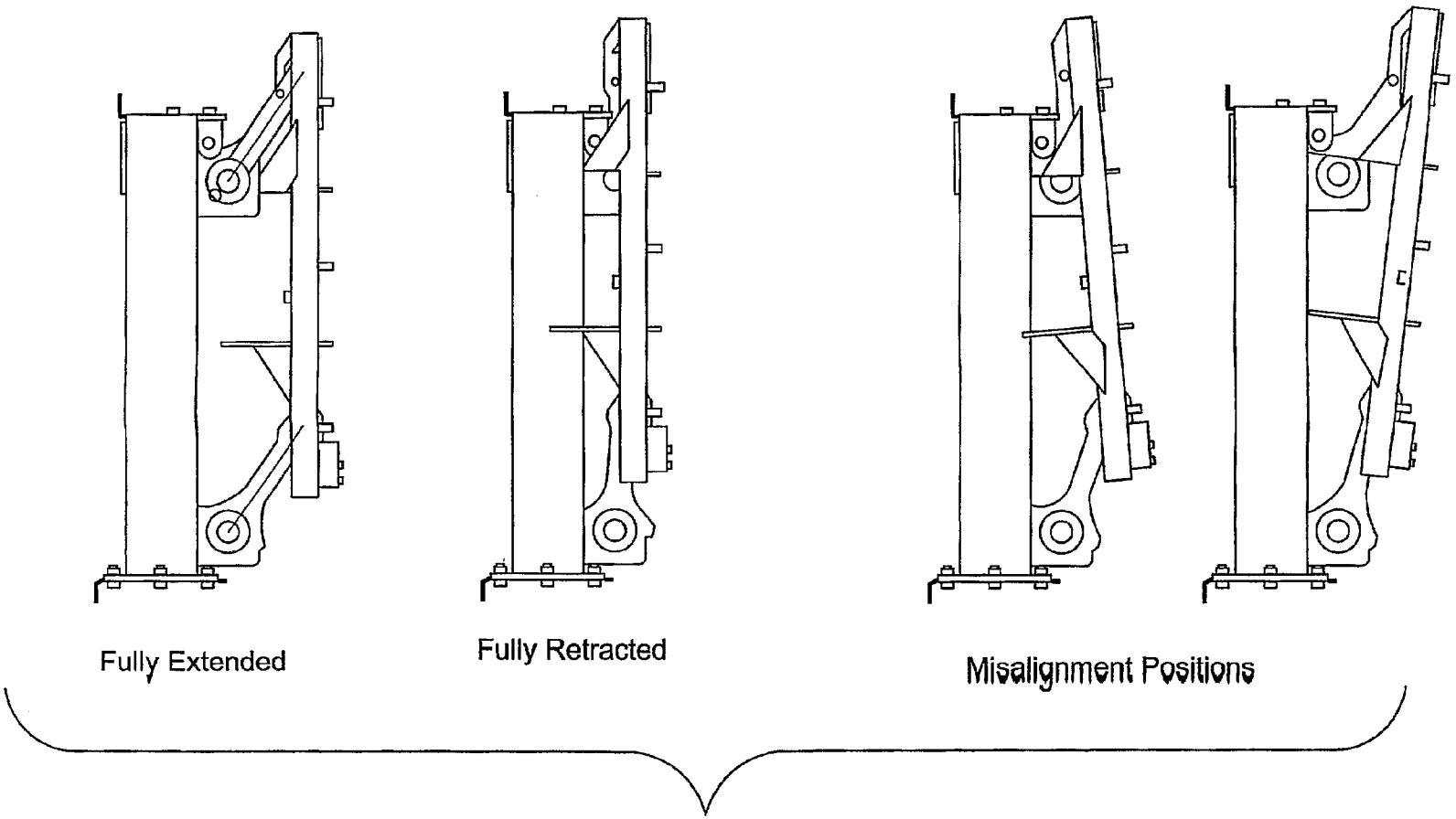
FIG. 15 illustrates a soft touch attachment for the suction cup array.

With reference to FIG. 15, the system may be provided with a soft touch attachment for the suction cup array. This could include, but is not limited to, isolation and suspension components to protect the medium being handled by the device. This component allows for four inches of motion for the panel to reduce the likelihood of material damage during the installation process. The soft touch variation allows the device to be used in the glass and stone fascia installation markets.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An attachment for a telescopic material handler enabling support and manipulation of a load, the attachment comprising:

a coupling section coupleable with the telescopic material handler;

a gripping system that securely holds the load;

a manipulation assembly supporting the gripping system and connected to the coupling section, the manipulation assembly being movable in at least five degrees of freedom independent from additional degrees of freedom provided by movements of the telescopic material handler; and an operator-controlled control system effecting control of the manipulation assembly, wherein the operator-controlled control system comprises a primary radio transmitter and a secondary radio transmitter, and wherein control of the load is transferable between the primary and secondary radio transmitters such that only one of the primary and secondary radio transmitters has control of the load at a time, the attachment further comprising control indicators providing a visual indication of which radio transmitter is in control of the load, wherein the manipulation assembly is pivotable about a first axis generally perpendicular to a ground plane, defining a first degree of freedom, the manipulation assembly comprising a main arm supporting the gripping system, wherein the main arm is pivotable about a second axis generally parallel to the ground plane, defining a second degree of freedom, the manipulation assembly further comprising a panel rotator assembly attached to the main arm via a four bar mechanism, wherein the four bar mechanism pivots the panel rotator assembly about a third axis generally parallel to the ground plane and the second axis, defining a third degree of freedom and effecting rotation of the load, wherein the gripping system is rotatable relative to the main arm by the panel rotator assembly about a fourth axis generally perpendicular to the second and third axes, defining a fourth degree of freedom and effecting rotation of the load about a normal axis, and wherein the gripping system is translatable relative to the main arm, defining a fifth degree of freedom.

2. An attachment according to claim 1, wherein the load comprises one of building panels and pipes.

3. A method of manipulating a load via an attachment to a telescopic material handler, the method comprising:

coupling the attachment to the telescopic material handler via a coupling section;

holding the load with a gripping system; and supporting the gripping system with a manipulation assembly connected to the coupling section for movement in at least five degrees of freedom independent from additional degrees of freedom provided by movements of the telescopic material handler via an operator-controlled control system, wherein the load comprises a cladding panel, the method further comprising flipping the cladding panel over prior to installation, wherein the flipping step comprises attaching the gripping system to a first side of the cladding panel, rotating the cladding panel about an axis generally parallel to a longitudinal axis of the cladding panel, releasing the cladding panel onto a support member, and attaching the gripping system to a second side of the cladding panel.

4. A method according to claim 3, comprising pivoting the manipulation assembly about a first axis generally perpendicular to a ground plane, defining a first degree of freedom, wherein the manipulation assembly includes a main arm supporting the gripping system, and wherein the method comprises pivoting the main arm about a second axis generally parallel to the ground plane, defining a second degree of freedom, wherein the manipulation assembly further includes a panel rotator assembly attached to the main arm via a four bar mechanism, wherein the method comprises pivoting the panel rotator assembly via the four bar mechanism about a third axis generally parallel to the ground plane and the second axis, defining a third degree of freedom and effecting rotation of the load, wherein the method further comprises rotating with the panel rotator assembly the gripping system relative to the main arm about a fourth axis generally perpendicular to the second and third axes, defining a fourth degree of freedom and effecting rotation of the load about a normal axis, and wherein the method further comprises translating the gripping system relative to the main arm, defining a fifth degree of freedom.

5. A method according to claim 3, wherein the gripping system further includes a vacuum switch that measures a vacuum level, the method further comprising generating a first signal indicating that sufficient vacuum has been achieved based on output from the vacuum switch.

6. A method according to claim 5, wherein the gripping system comprises a vacuum pump, a plurality of vacuum cups, and a vacuum reservoir, wherein the vacuum cups are divided into at least two independent circuits, and wherein each independent circuit includes a vacuum reservoir, each independent circuit of the gripping system further comprising a manifold valve that separates its respective vacuum reservoir from the vacuum pump, and wherein upon failure of the vacuum pump, the method comprising closing each of the manifold valves to preserve vacuum in its respective reservoir.

7. A method according to claim 5, further comprising activating a second signal when the vacuum level is below a predetermined level.

* * * * *